US009440815B2

(12) United States Patent
Pellegrin et al.

(10) Patent No.: US 9,440,815 B2
(45) Date of Patent: Sep. 13, 2016

(54) SORTING MACHINE FOR SORTING FLAT ARTICLES ON EDGE AT A REDUCED NOISE LEVEL

(71) Applicant: Solystic, Gentilly (FR)

(72) Inventors: Laurent Pellegrin, Livron (FR); Fabrice Duchemin, Le Grand Serre (FR)

(73) Assignee: SOLYSTIC, Gentilly (FR)

( * ) Notice: Subject to any disclaimer, the term of this patent is extended or adjusted under 35 U.S.C. 154(b) by 0 days.

(21) Appl. No.: 13/822,338

(22) PCT Filed: Jan. 22, 2013

(86) PCT No.: PCT/FR2013/050135
§ 371 (c)(1),
(2) Date: Aug. 20, 2014

(87) PCT Pub. No.: WO2013/117837
PCT Pub. Date: Aug. 15, 2013

(65) Prior Publication Data

US 2015/0016938 A1 Jan. 15, 2015

(30) Foreign Application Priority Data

Feb. 7, 2012 (FR) ..... 12 51128

(51) Int. Cl.
*B65H 31/06* (2006.01)
*B65H 29/40* (2006.01)
(Continued)

(52) U.S. Cl.
CPC ..... *B65H 31/06* (2013.01); *B07C 3/02* (2013.01); *B65H 29/40* (2013.01); *B65H 29/52* (2013.01);
(Continued)

(58) Field of Classification Search
CPC ..... B65H 31/00; B65H 31/02; B65H 31/04; B65H 31/06; B65H 31/08; B65H 31/10; B65H 31/12; B65H 31/24; B65H 2515/82; B65H 2601/521; B65H 29/40; B65H 29/52; B65H 29/58; B65H 2301/321; B65H 2301/421; B65H 2301/4212; B65H 2301/42124; B65H 2301/4214; B65H 2301/42146
USPC ..... 271/3.01, 3.12, 207, 264, 278, 198, 271/279, 287, 288, 289, 290, 297, 298, 300
See application file for complete search history.

(56) References Cited

U.S. PATENT DOCUMENTS 4,056,264 A * 11/1977 Dhooge ..... B65H 29/22 271/177
6,481,712 B1 * 11/2002 Yap ..... B07C 3/065 271/177

(Continued)

FOREIGN PATENT DOCUMENTS

DE 11 20 984 12/1961
DE 32 05 607 8/1983

(Continued)

*Primary Examiner* — Ernesto Suarez
(74) *Attorney, Agent, or Firm* — Ware, Fressola, Maguire & Barber LLP

(57) ABSTRACT

A sorting machine (1) for sorting flat articles on edge, which machine has sorting outlets (2) for stacking the sorted flat articles, each of which sorting outlets is equipped with a stacking actuator (5) and with at least one slide plate (4) having a front face (40) against which the flanks of the flat articles slide while the flat articles are being stacked, the sorting machine (1) being provided with a noise damper and reducer (8, 12) for damping and reducing noise generated by the flat articles while they are being stacked, at least a portion of the noise damper and reducer (8) being provided on the slide plate (4).

4 Claims, 2 Drawing Sheets

(51) Int. Cl.
*B65H 29/52* (2006.01)
*B07C 3/02* (2006.01)
*G10K 11/16* (2006.01)

(52) U.S. Cl.
CPC ..... *G10K 11/16* (2013.01); *B65H 2301/321* (2013.01); *B65H 2301/4214* (2013.01); *B65H 2408/111* (2013.01); *B65H 2515/82* (2013.01); *B65H 2601/521* (2013.01); *B65H 2701/1916* (2013.01)

(56) References Cited

U.S. PATENT DOCUMENTS 6,846,151 B2 * 1/2005 Mayerberg, II ..... B65H 29/52 271/211
7,823,868 B2 * 11/2010 Taki ..... B42B 4/00 270/58.07
7,967,291 B1 * 6/2011 Ayala ..... B65H 29/58 271/220
8,276,902 B2 * 10/2012 Holland-Letz ..... B65H 29/40 271/3.14
8,459,636 B2 * 6/2013 Moulin ..... B07C 3/008 271/180
2009/0014937 A1 1/2009 Taki et al.
2009/0026691 A1 * 1/2009 Ishikawa ..... B65H 5/062 271/10.12
2010/0207323 A1 * 8/2010 Kumeta ..... B65H 5/38 271/264

FOREIGN PATENT DOCUMENTS

FR WO 2011157919 A1 * 12/2011 ..... B07C 3/008
JP 57 049854 3/1982
JP 10007288 A * 1/1998
JP 2011 255318 12/2011

* cited by examiner

SORTING MACHINE FOR SORTING FLAT ARTICLES ON EDGE AT A REDUCED NOISE LEVEL

CROSS REFERENCE TO RELATED APPLICATIONS

This application is the U.S. National Stage of International Application Number PCT/FR2013/050135 filed on Jan. 22, 2013, which application is claiming priority under 35 USC §119 to French Patent Application No. 12 51128 filed on Feb. 7, 2012, which applications are hereby incorporated by reference in their entirety.

TECHNICAL FIELD

The invention relates generally to a sorting machine for sorting flat articles on edge, which machine has sorting outlets for stacking the sorted flat articles, each of which sorting outlets is equipped with a stacking actuator and with at least one slide plate having a front face against which the flanks of the flat articles slide while the flat articles are being stacked.

PRIOR ART

That type of sorting machine is widely known and is used to sort flat articles such as, for example, mailpieces, and for stacking them on edge. Such sorting machines have a plurality of sorting outlets, at each of which the mailpieces are stacked in compliance with a predetermined sorting plan. The mailpieces processed in this way can be of a wide variety of dimensions, materials, and weight, and, for example, are of weight varying in the range a few grams to 350 grams. Each stack of mailpieces is then unloaded manually by an operator who, for example, places it in a storage tray. Operation of the sorting machine thus requires permanent activity by at least one operator for emptying the sorting outlets and for re-supplying empty storage trays. Unfortunately, the mailpieces being stacked on edge generates high levels of noise, making the working conditions of the operators difficult close to the sorting outlets. In order to reduce that noise, certain sorting machines are equipped with noise barriers formed by flexible curtains made of polyurethane and hung between the sorting outlets and the operators. Such noise barriers are of limited effectiveness and the noise levels in the vicinity of the sorting outlets remain too high for the operators. In addition, such barriers hinder the operators while they are unloading the stacks, and are of limited lifespan.

Publication JP 57 049 854 describes, as prior art, a mailpiece stacker including a slide plate along which the surfaces of the flat articles slide, and a mechanical absorption plate, perpendicular to the slide plate, and against which the edges of the flat articles come into abutment during the stacking. The mechanical absorption plate is designed to absorb impacts against the edges of the flat articles. The mechanical absorption plate is fastened to the frame of the stacker, from which it is separated by a sound-proofing plate designed to absorb the noise generated by the impacts of the flat articles coming into contact with the mechanical absorption plate. That stacker is noisy. That document therefore proposes a stacker that is designed to be less noisy, and that includes a mechanical absorption plate that is offset from the frame and that is suitable for deforming under the effect of impacts from the edges of the flat articles. However, that solution is not good, and the noise level remains high.

SUMMARY OF THE INVENTION

An object of the invention is to remedy those drawbacks by proposing a sorting machine having a noise level that is reduced effectively and durably while also preserving good compactness and good ergonomics.

To this end, the invention provides a sorting machine for sorting flat articles on edge, which machine has sorting outlets for stacking the sorted flat articles, each of which sorting outlets is equipped with a stacking actuator and with at least one slide plate having a slide front face against which the flanks of said flat articles slide while the flat articles are being stacked, said sorting machine being characterized in that it is provided with noise damper and reducer means designed to co-operate with the front face to absorb the noise, in particular the noise generated by the flat articles while they are being stacked, at least a portion of the noise damper and reducer means being provided on and along said slide plate, the front face of the slide plate having at least a first zone of perforations that is provided with a plurality of first orifices extending through the slide plate and forming, at least in part, the noise damper and reducer means. In addition to absorbing the noise associated with stacking the flat articles, the noise damper and reducer means also make it possible to absorb the noise internal to the sorting machine, e.g. the noise generated by the flat articles travelling through the sorting machine.

The basic idea of the invention is to incorporate noise damper and reducer means into the existing equipment of a sorting machine. The arrangement of the noise damper and reducer means combined with the slide plate thus makes it possible to reduce the noise level while also not hindering the work of the operators and while not generating any risk of prematurely damaging the noise damper and reducer means. Thus, the noise damper and reducer means act as effective acoustic absorption means.

The sorting machine of the invention may advantageously have the following features:

- the first zone of perforations extends over the entire surface area of the front face of the slide plate;
- the slide plate has a back face opposite from the front face and covered with a layer of absorbent material forming, in part, the noise damper and reducer means;
- the layer of absorbent material is superposed on said first zone of perforations;
- the stacking actuator is of the bucket wheel type, and has a hub provided behind the slide plate and from which there extend at least two series of curved spurs that are axially offset, the spurs being suitable for receiving the flat articles while they are being stacked, the slide plate being provided with at least two slots allowing the spurs to pass through them, the first zone of perforations being provided at least between the slots; and
- the sorting machine is provided with a sheet-metal cover provided above the sorting outlets and arranged to cover the slide plates at least in part, the sheet-metal cover having second zones of perforations provided between two consecutive slide plates and forming, in part, said noise damper and reducer means.

BRIEF DESCRIPTION OF THE DRAWINGS

The present invention can be better understood and other advantages appear on reading the following detailed description of an embodiment given by way of non-limiting example and with reference to the accompanying drawings, in which.

DESCRIPTION OF THE EMBODIMENTS

Figure 1:
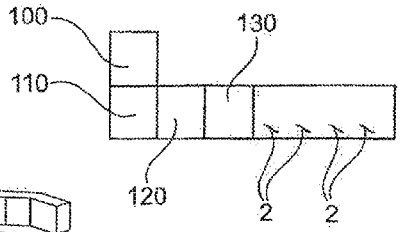
FIG. 1 is a diagrammatic plan view of a sorting machine of the invention.

With reference to FIG. 1, the sorting machine 1 of the invention includes, in succession, a storage magazine 100 for storing flat articles, an unstacker 110 suitable for unstacking the flat articles and for putting the unstacked flat articles in series, a conveyor 120 for conveying the flat articles, a decoding system 130 for decoding addresses on the flat articles, and a plurality of sorting outlets 2, at which flat articles (not shown), such as, for example, mailpieces, are stacked.

Figure 2:
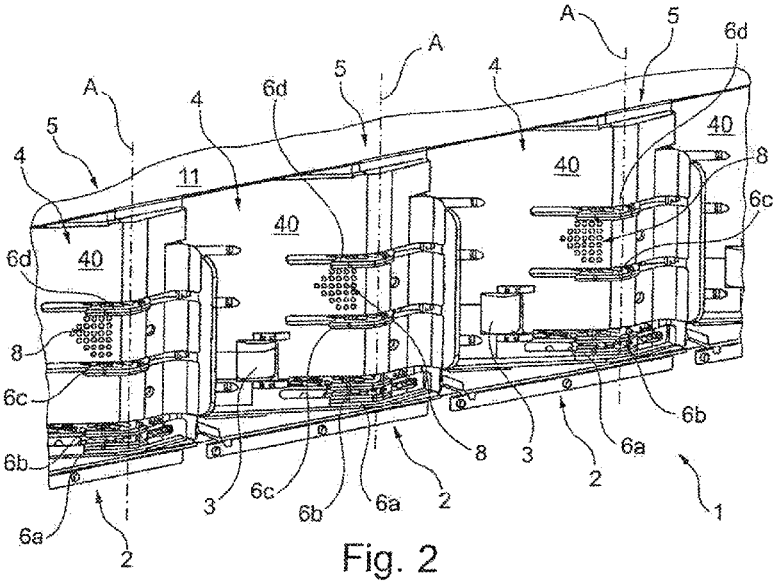
FIGS. 2 and 3 are perspective views respectively slightly from above and slightly from below, showing a portion of the sorting machine of the invention, at the sorting outlets, which are equipped with slide plates provided with zones of perforations, only a portion of each zone of perforations being shown.
Figure 3:
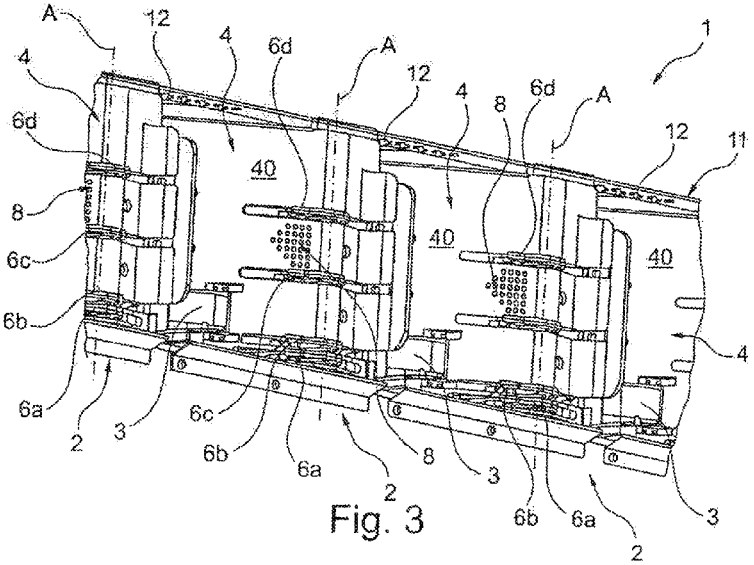

With reference to FIGS. 2 and 3, the flat articles are conveyed on edge by conveyor belts 3 of the endless-belt type and are guided towards one or other of the sorting outlets 2 by substantially vertical slide plates 4, along the slide front face 40 of each of which the flanks of the flat articles slide. These slide plates 4 are of shapes and dimensions that are well known in the field of sorting machines, and they are not described in any detail beyond points of direct concern to the invention.

Each sorting outlet 2 is provided with a stacking actuator 5 of the bucket wheel type that is suitable for stacking the flat articles. Each stacking actuator 5 has a hub (represented by a respective one of the axes A) provided behind the corresponding slide plate 4 and from which a plurality of series of curved spurs 6*a*-6*d* extend that are distributed along the axis A. In the example shown, the stacking actuator 5 is provided with four series of spurs 6*a*-6*d*, namely two lower and mutually adjacent series of spurs 6*a*, 6*b*, these series being provided in register with the path of the bottoms of the flat articles, and two upper series of spurs 6*c*-6*d*, these series being spaced apart from each other and distributed heightwise in the middle portion of the slide plate 4. In known manner, in their concave portions, the spurs 6*a*-6*d* are suitable for receiving, one after another, the flat articles arriving at the corresponding sorting outlet 2, and for accompanying their movement while they are being stacked. The slide plate 4 is provided with slots 7 passing through it, the slots being provided in register with the series of spurs 6*a*-6*d* and allowing the spurs 6*a*-6*d* to pass through the slide plate 4 so that they can receive flat articles traveling past the slide plates 4.

Figure 4A:
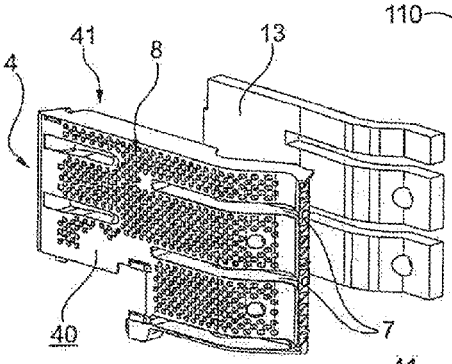
FIG. 4A is a front perspective view showing a slide plate of a sorting outlet of the sorting machine in a first embodiment of the invention, and showing the layer of absorbent material prior to assembly.

In a first embodiment shown in FIG. 4A, the slide front face 40 of the slide plate 4 has a first zone of perforations 8 provided with first circular orifices extending through the slide plate 4. In advantageous manner, this first zone of perforations 8 extends over the entire surface area of the slide plate 4. The particular arrangement of the zone of perforations 8, superposed on the slide front face 40, makes it possible to obtain good acoustic absorption of noise.

Figure 4B:
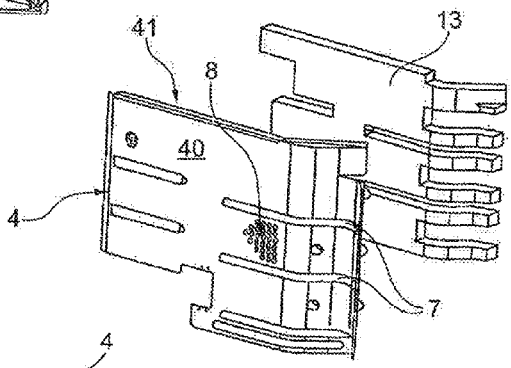
FIG. 4B is view similar to the FIG. 4A view for a second embodiment of the invention.

In a second embodiment shown in FIG. 4B, the first zone of perforations 8 extends over a limited zone situated between the two slots 7 provided in the middle portion of the front face 40.

Figure 5:
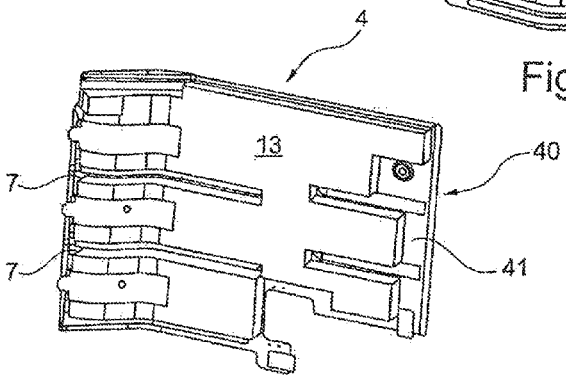
FIG. 5 is a back perspective view of one of the slide plates of FIG. 4A or 4B and of the layer of absorbent material, as assembled together.

The back face 41 of the slide plate 4 is covered with a layer of absorbent material 13 (visible in FIGS. 4 and 5), e.g. a layer of "RESORBSON S 20 F PUN" foam, this layer having, for example, a thickness of 20 millimeters (mm). The layer of absorbent material 13 is of shape and dimensions substantially similar to those of the slide plate 4 carrying it so as to cover the largest possible area of the back surface without, however, extending beyond it. The layer of absorbent material 13 is thus disposed so as not to be directly in the path of the flat articles so that there is no risk of it being damaged. In addition, the layer of absorbent material 13 covers the first orifices of the first zone of perforations 8, thereby enabling the layer of absorbent material to damp even further the noise passing through the first orifices. The particular arrangement of the layer of absorbent material 13, superposed on the slide front face 40, makes it possible to obtain good acoustic absorption of noise.

Above the sorting outlets 6*a*-6*d*, the sorting machine 1 is provided with a sheet-metal cover 11 (visible in FIGS. 2 and 3) covering the slide plates 4 at least in part. Between two slide plates 4, the sheet-metal cover 11 has second zones of perforations 12. The second zones of perforations 12 are preferably mutually discontinuous, thereby making it possible to preserve the stiffness of sheet-metal cover 11. For example, each second zone of perforations 12 has a plurality of second circular orifices extending through it.

When the flat articles are conveyed by the sorting machine 1 and then stacked at the sorting outlets 2, the noise, in particular the noise generated by the flat articles travelling, is, to a large extent, absorbed by the orifices of the first and second zones of perforations 8, 12, and by the layer of absorbent material 13. The first and second zones of perforations 8, 12 and the layer of absorbent material 13 thus act as effective acoustic absorption means. The working conditions of the operators are thus greatly improved. In addition, the first and second zones of perforations 8, 12 are provided in such a manner as not to hinder the movements of the operators. The ergonomics and the compactness of the sorting machine 1 are thus preserved.

Naturally, the present invention is in no way limited to the above description of the embodiment, and can undergo modifications without going beyond the ambit of the invention.

What is claimed is:

1. A sorting machine for sorting flat articles on edge comprising:

sorting outlets for stacking the sorted flat articles, each of which sorting outlets is equipped with a stacking actuator and with at least one slide plate having a slide front face against which flanks of said flat articles slide while said flat articles are being stacked, noise damper and reducer means designed to co-operate with said front face to absorb noise, in particular noise generated by said flat articles while the flat articles are being stacked, at least a portion of the noise damper and reducer means being provided on and along said slide plate, said front face of said slide plate having at least a first zone of perforations that is provided with a plurality of first orifices extending through said slide plate and forming, at least in part, said noise damper and reducer means, a sheet-metal cover provided above said sorting outlets and arranged to cover all of said slide plates and all of said sorting outlets, said sheet-metal cover having second zones of perforations provided between two consecutive slide plates and forming, in part, said noise damper and reducer means, each second zone of perforations discontinuous from each other second zone of perforations so as to preserve stiffness of the sheet-metal cover, and each second zone of perforations having a plurality of second circular orifices adjacent to each other and extending through the sheet-metal cover, wherein said stacking actuator is of the bucket wheel type, and has a hub provided behind said slide plate and from which there extend at least two series of curved spurs that are axially offset, said spurs being suitable for receiving the flat articles while they are being stacked, said slide plate being provided with at least two slots allowing said spurs to pass through them, said first zone of perforations being provided only between said slots.

2. The sorting machine for sorting flat articles on edge according to claim 1, characterized in that said first zone of perforations extends over the entire surface area of said front face of said slide plate.

3. The sorting machine for sorting flat articles on edge according to claim 1, characterized in that said slide plate has a back face opposite from said front face and covered with a layer of absorbent material forming, in part, said noise damper and reducer means.

4. The sorting machine for sorting flat articles on edge according to claim 3, characterized in that said layer of absorbent material is superposed on said first zone of perforations.

* * * * *